US012478116B2

(12) United States Patent
West

(10) Patent No.: US 12,478,116 B2
(45) Date of Patent: Nov. 25, 2025

(54) WEARABLE THERMAL CONDITIONING SYSTEMS

(71) Applicant: WEARABLE THERMAL CONDITIONING SYSTEMS LLC, Costa Mesa, CA (US)

(72) Inventor: Scott Allen West, Mesa, AZ (US)

(73) Assignee: Wearable Thermal Conditioning Systems LLC, Costa Mesa, CA (US)

( * ) Notice: Subject to any disclaimer, the term of this patent is extended or adjusted under 35 U.S.C. 154(b) by 136 days.

(21) Appl. No.: 18/551,831

(22) PCT Filed: Mar. 22, 2022

(86) PCT No.: PCT/US2022/021349
§ 371 (c)(1),
(2) Date: Sep. 21, 2023

(87) PCT Pub. No.: WO2022/204149
PCT Pub. Date: Sep. 29, 2022

(65) Prior Publication Data

US 2024/0156185 A1 May 16, 2024

Related U.S. Application Data

(60) Provisional application No. 63/165,360, filed on Mar. 24, 2021.

(51) Int. Cl.
*A41D 13/005* (2006.01)
*A41D 1/04* (2006.01)
*A41D 13/002* (2006.01)

(52) U.S. Cl.
CPC ..... *A41D 13/0053* (2013.01); *A41D 1/04* (2013.01); *A41D 13/0025* (2013.01)

(58) Field of Classification Search
CPC ..... A41D 13/0053; A41D 13/0025
See application file for complete search history.

(56) References Cited

U.S. PATENT DOCUMENTS 3,085,405 A * 4/1963 Frantti ..... A62B 17/005 607/104
6,076,358 A 6/2000 Bin-Nun
(Continued)

FOREIGN PATENT DOCUMENTS

| | | |
|---|---|---|
| CN | 106322808 | 1/2017 |
| CN | 112293816 | 2/2021 |
| JP | 2017110324 A | 6/2017 |

OTHER PUBLICATIONS

International Search Report and Written Opinion dated Aug. 30, 2022 for Application No. PCT/US2022/021349.
(Continued)

*Primary Examiner* — Lionel Nouketcha
(74) *Attorney, Agent, or Firm* — SNELL & WILMER L.L.P.

(57) ABSTRACT

A wearable garment, such as a vest, for providing thermal conditioning, for example cooling and/or heating, to a user. The vest may be used with cryogenic temperatures. Peltier devices, pre-charged nitrogen canisters, or miniature Stirling cryocoolers may be mounted and built into the wearable or externally carried or mounted thereto. A pump, such as a vacuum diaphragm pump, causes thermally conditioned air to flow through a series of porous regenerative tubing and/or porous panels to supply conditioned air to a user of the garment. The system may use a cryocooler having a pulsating cold finger. The cryo embodiments may supply −200° C. gas through the panels or tubing. Portable systems can be carried or attached, such as HVAC, refrigeration, heating or
(Continued)

the like. Control systems may regulate the temperature and may be adjusted by a user, for example using an input pad or a mobile device.

17 Claims, 10 Drawing Sheets

(56) References Cited

U.S. PATENT DOCUMENTS

| | | | | |
|---|---|---|---|---|
| 6,089,226 | A * | 7/2000 | Gier | A61B 18/02 128/201.21 |
| 2005/0066401 | A1 | 3/2005 | Feher | |
| 2006/0191277 | A1 | 8/2006 | Defosset | |
| 2012/0227432 | A1* | 9/2012 | Creech | A41D 13/0053 62/259.3 |
| 2020/0016958 | A1* | 1/2020 | Stasky | B60H 1/00271 |
| 2020/0178621 | A1 | 6/2020 | Kittaka et al. | |
| 2020/0281284 | A1* | 9/2020 | Mcallister | A41D 13/0053 |
| 2021/0037900 | A1* | 2/2021 | Itao | G05D 23/1919 |
| 2021/0059854 | A1* | 3/2021 | Yazawa | A61F 7/02 |

OTHER PUBLICATIONS

European Patent Office, European Search Report dated Jun. 3, 2025 in Application No. 22776474.3.

* cited by examiner

WEARABLE THERMAL CONDITIONING SYSTEMS

BACKGROUND

Field

The technology generally relates to conditioning systems, in particular to wearable thermal conditioning systems.

Description of the Related Art

Thermal conditioning, i.e. providing cooling and/or heating, is needed to maintain desirable temperatures. Some activities benefit from thermal conditioning on a personal level. Existing solutions to providing personal thermal conditioning are bulky, expensive, and do not deliver adequate conditioning. Improvements to these and other drawbacks to existing personal thermal conditioning approaches are desirable.

SUMMARY

The embodiments disclosed herein each have several aspects no single one of which is solely responsible for the development's desirable attributes. Without limiting the scope of this disclosure, its more prominent features will now be briefly discussed. After considering this discussion, and particularly after reading the section entitled "Detailed Description," one will understand how the features of the embodiments described herein provide advantages over existing systems, devices and methods for wearable thermal conditioning.

The following description includes non-limiting examples of some embodiments. For instance, other embodiments of the described systems, devices and methods may or may not include the features described herein. Moreover, described advantages and benefits may apply only to certain embodiments and should not be used to limit the disclosure.

A wearable thermal conditioning system is described. The system may deliver a fine nitrogen gas, for example reaching temperatures of negative two-hundred degrees Celsius (−200° C.). A vest may use regenerative tubing connected to peltier devices, pre-sealed nitrogen canisters, mini micro Stirling cryocoolers, handheld or miniature heating, ventilation and air condition (HVAC) systems, refrigeration systems, and/or heating systems. A miniature diaphragm pump or air compressor may connect by the regenerative tubing to an inlet that pulls a vacuum from the cooling unit outlet. The pump or compressor may connect to and provide cooling using regenerative tubing having micro air holes. The system may further include panels, liners, and/or solid state hand-held refrigerators. A controller and/or regulator may be used to control the system, for example with a software application on a mobile device.

In one aspect, a wearable thermal conditioning system is described. The system comprises a wearable garment, one or more peltier devices, one or more tubes, a pump and a power source. The one or more peltier devices are attached to the wearable garment. The one or more tubes have openings along a length thereof, with each tube extending from one of the one or more peltier devices and across a respective region of the wearable garment where cooling is to be supplied. The pump is attached to the wearable garment and is configured to pump air across the one or more peltier devices and through the one or more tubes. The power source is attached to the wearable garment and is configured to power the one or more peltier devices and the pump.

In some embodiments, the system further comprises one or more panels fluidly connected to the one or more tubes, the panels comprising a series of openings and configured to expel pumped air therethrough to provide cooling. In some embodiments, the wearable garment is a vest.

In another aspect, a wearable thermal conditioning system is described. The system comprises a wearable garment, one or more peltier devices, one or more panels, a pump, and a power source. The one or more peltier devices are attached to the wearable garment. The one or more panels comprise a series of openings and are configured to expel pumped air therethrough to provide cooling. The pump is attached to the wearable garment and is configured to pump air across the one or more peltier devices and through the one or more panels. The power source is attached to the wearable garment and is configured to power the one or more peltier devices and the pump.

In some embodiments, the system further comprises a plurality of the panels substantially covering the majority of the surface area of the wearable garment. In some embodiments, the system further comprises tubing fluidly connecting the one or more panels to the pump. In some embodiments, the wearable garment is a vest.

In another aspect, a wearable thermal conditioning system is described. The system comprises a wearable garment, one or more miniature Stirling cryo-coolers, a series of porous tubes and/or porous panels, a vacuum diaphragm pump, and a power source. The one or more miniature Stirling cryo-coolers are attached to the wearable garment. The series of porous tubes and/or porous panels are fluidly connected with the one or more cryo-coolers, where each tube and/or panel extends across a respective region of the wearable garment where cooling is to be supplied. The vacuum diaphragm pump is attached to the wearable garment and is configured to cause air thermally conditioned by the one or more cryo-coolers to move through each tube and/or panel. The power source is attached to the wearable garment and is configured to power the one or more cryo-coolers and the pump. In some embodiments, the wearable garment is a vest.

In another aspect, a wearable thermal conditioning system is described. The system comprises a wearable garment, a freeze box, a gas canister, a series of porous tubes and/or porous panels, a vacuum diaphragm pump, and a power source. The freeze box is attached to the wearable garment. The gas canister is in fluid connection with the freeze box. The series of porous tubes and/or porous panels are fluidly connected with the freeze box, where each tube and/or panel extends across a respective region of the wearable garment where cooling is to be supplied. The vacuum diaphragm pump is attached to the wearable garment and is configured to cause air thermally conditioned by the freeze box to move through the tube and/or panel. The power source is attached to the wearable garment and configured to power the freeze box and the pump. In some embodiments, the wearable garment is a vest.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with additional specificity and detail through use of the accompanying drawings. In the following detailed description, reference is made to the accompanying drawings, which form a part hereof. In the drawings, similar symbols typically identify similar components, unless context dictates otherwise.

Figure 1:
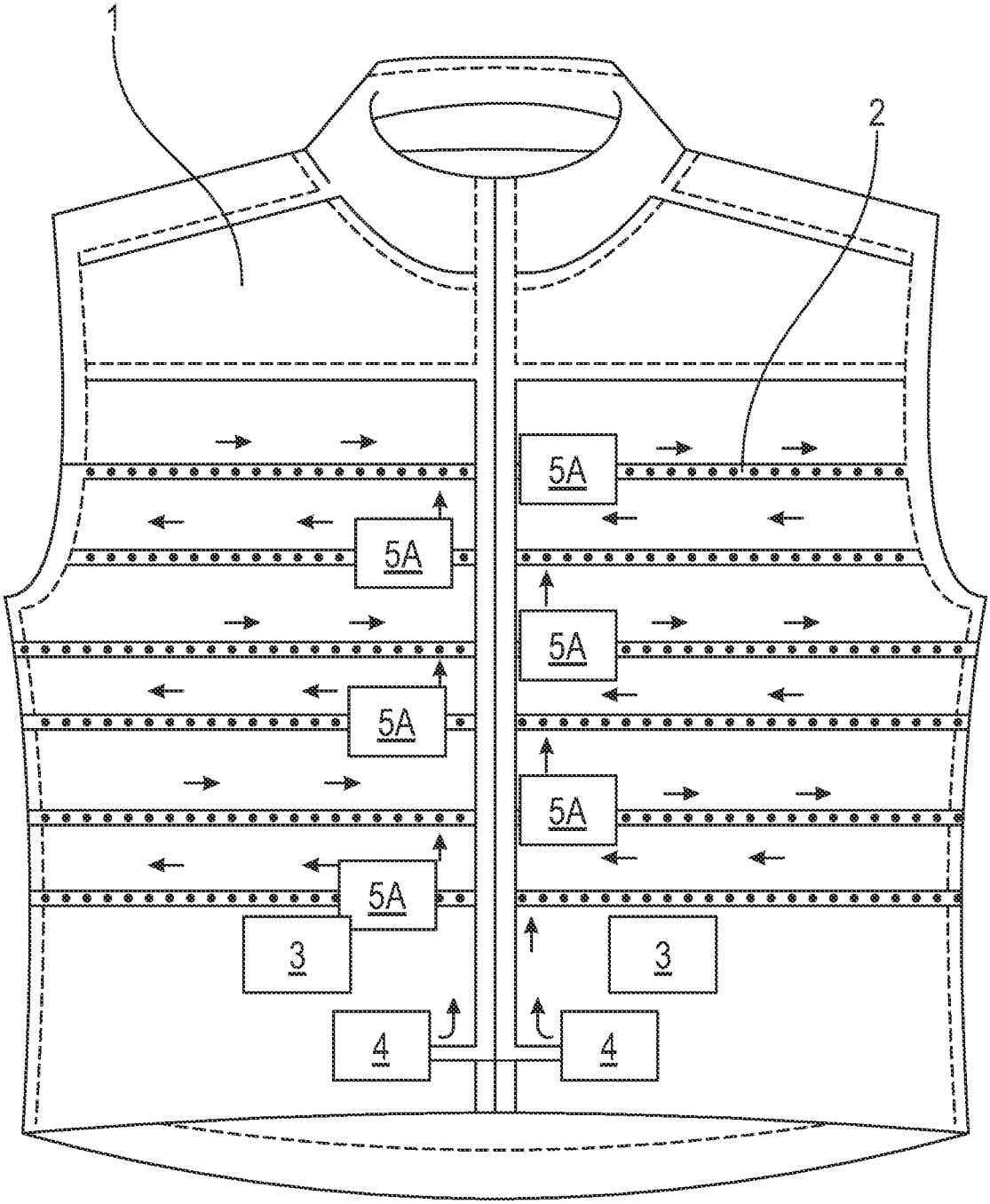
FIG. 1 is a front view of an embodiment of a wearable thermal conditioning system using porous regenerative tubing.

While the above-identified drawings set forth presently disclosed embodiments, other embodiments are also contemplated, as noted in the discussion. This disclosure presents illustrative embodiments by way of representation and not limitation. Numerous other modifications and embodiments can be devised by those skilled in the art which fall within the scope and spirit of the principles of the presently disclosed embodiments.

DETAILED DESCRIPTION

The following detailed description is directed to certain specific embodiments of the wearable thermal conditioning systems, devices and methods. In this description, reference is made to the drawings wherein like parts or steps may be designated with like numerals throughout for clarity. Reference in this specification to "one embodiment," "an embodiment," or "in some embodiments" means that a particular feature, structure, or characteristic described in connection with the embodiment is included in at least one embodiment of the invention. The appearances of the phrases "one embodiment," "an embodiment," or "in some embodiments" in various places in the specification are not necessarily all referring to the same embodiment, nor are separate or alternative embodiments necessarily mutually exclusive of other embodiments. Moreover, various features are described which may be exhibited by some embodiments and not by others. Similarly, various requirements are described which may be requirements for some embodiments but may not be requirements for other embodiments. Reference will now be made in detail to certain embodiments of the invention, examples of which are illustrated in the accompanying drawings. Wherever possible, the same reference numbers will be used throughout the drawings to refer to the same or like parts.

Various embodiments of wearable thermal conditioning systems, devices and methods are described. Some embodiments are shown as a vest, and more particularly, as a cryo cooling vest. Although the systems may be described with respect to cooling, similar principles and designs as described herein may be used to provide heating, either alternatively or in addition to cooling. The cooling system not only keeps humans and animals cold, it may also strengthen immune systems, by fine gas holes throughout the vest liner or seepage through clothing textile directly to a user's skin.

The wearable may be used for cooling and/or cryotherapy. The cryovest is customizable and extremely lightweight, durable and can be built into any vest design. There are many portable applications that can be used unattached to the vest that one can carry such as HVAC, refrigeration, heating or the like. Peltier devices, pre-charged nitrogen canisters or miniature Stirling cryocoolers may be mounted and built into the wearable or externally carried or mounted thereto. A Stirling cryocooler creates nitrogen gas and a cold tip is connected to the inlet of a vacuum diaphragm pump and its outlet with enough pressure to slowly move through regenerative tubing and maze chambered panels of the interior liner. The entire vest may be constantly cold and blowing negative 200 degree gas through seepage material or small holes in clothing material designed to not let any air escape until it hits human or animal skin. The weight of the garment is negligible, the system is easy to operate, hidden and unobtrusive, requires no maintenance, and may be thermostat controlled, e.g. to temperatures below 60 degrees Fahrenheit (F), by the use of a cellular telephone or other mobile device or computer. Batteries can be nuclear energy or any twenty four volt battery, such as lithium ion or sodium ion, and/or use solar energy. Battery life is over eight hours of continual use. The system can also use a vest, quick release attached to regenerative tubing, mount to a belt, placed in a carrying case, or hidden inside a purse or the like.

The vest may be used as a cryovest. The system may be used for cryotherapy. Various benefits of these and other embodiments of the system include decreased pain, swelling and inflammation, accelerated muscle recovery time, increased energy and assistance in post-injury recovery and rehabilitation. The system may be worn indoors or outdoors in any environment as it is unnoticeable, noiseless, easy to use, unobtrusive, burns calories, strengthens the immune system, and may cover the entire upper body reducing core temperatures in extreme heat like an air conditioner. The system can be sold at a reasonable price and by redesigning for safety can be built into any wearable, for example any vest, on the market.

Human thermoregulatory models and physiological simulation models may guide design of the system. Data on thermoregulatory control functions may be used with detailed, multi-segmental models of human thermoregulation. Such models combine the physics of internal and external heat flow with internal body temperature regulation. The systems described herein provide enhanced thermoregulation with low weight and air conditioning that can be regulated.

In some embodiments, a wearable thermal conditioning system delivers a fine nitrogen gas reaching temperatures of −50 degrees Celsius (° C.) or less, −100° C. or less, −150° C. or less, or −200° C. or less. In accordance with various embodiments, the mechanisms for delivering the coldest air achievable known to man includes a system comprising a vest that uses regenerative tubing that can connect to one or more peltier devices, pre-sealed nitrogen canisters, mini micro Stirling cryocoolers, or a handheld HVAC system, refrigeration systems, heating systems, or the like. The system may use a mini micro diaphragm pump or air compressor that is connected by regenerative tubing to the inlet that pulls a vacuum from the cooling unit outlet. The pump or compressor then connects to regenerative tubing and can cool using regenerative tubing with micro air holes, with panels having air holes, or an entire vest liner arranged in a distributed maze-like configuration that allows the entire vest to keep the user cool. Solid state hand-held refrigerators may be used to wrap around motors of components along with other heat sources to cool the devices so as to rid the vest of heat and make it safe. The components are automatic, portable, mountable and removable and can be replaced and may be used in combination with one another. A controller and regulator may be used to create the perfect temperature for control by an external input device, such as a cell phone or other mobile device. These and other features will now be shown and described with respect to the figures.

Figure 2:
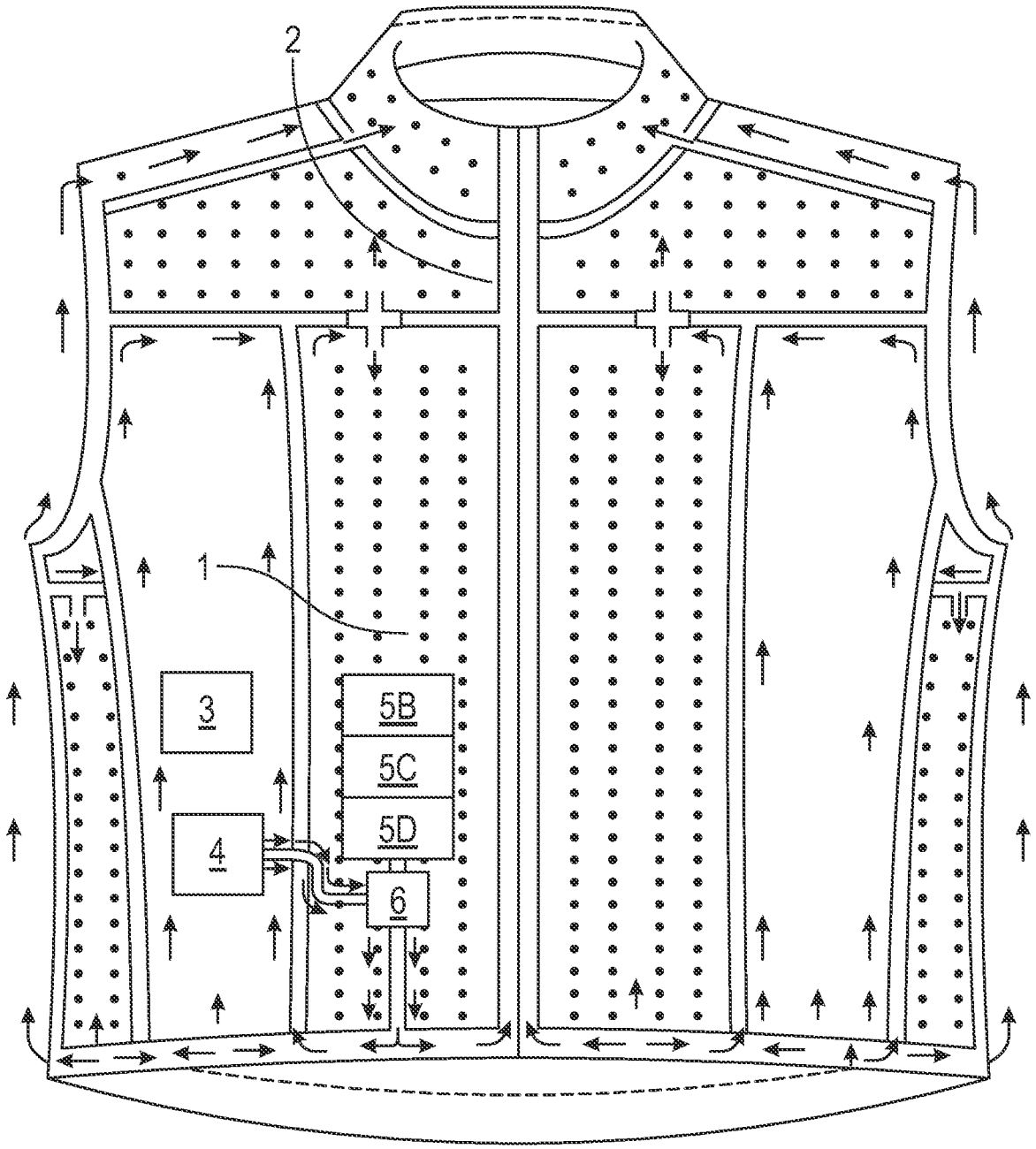
FIG. 2 is a front view of another embodiment of a wearable thermal conditioning system using porous panels.

FIG. 1 is a front view of an embodiment of a wearable thermal conditioning system using non porous or porous regenerative tubing 2 that can be made of material such as polyepropylene, polyethelyne, or any of the other types of materials described herein, including materials that can be used with cryogenics due to temperatures around or below 80 degree kelvin (K). The tubing 2 is designed to run horizontally or vertically as shown in FIGS. 1-2 and can be arranged in various other ways. The tubing 2 may be stitched into the vest or slid through a sleeve with a thin enough liner to let cold air blow through micro blowholes 16. The system is shown as a vest and further includes batteries 3 that connect to the vacuum or pressure pump 4 and connect to peltier devices 5A.

One or more panels 1 may be included throughout the vest. The panel 1 may include material that is used in military or other fatigues and that have all the components either sewn in or placed into hidden pockets or mounted on the outside. The panels 1 may also be included in the upper chest areas, collar areas, side areas, front and back areas.

Figure 3:
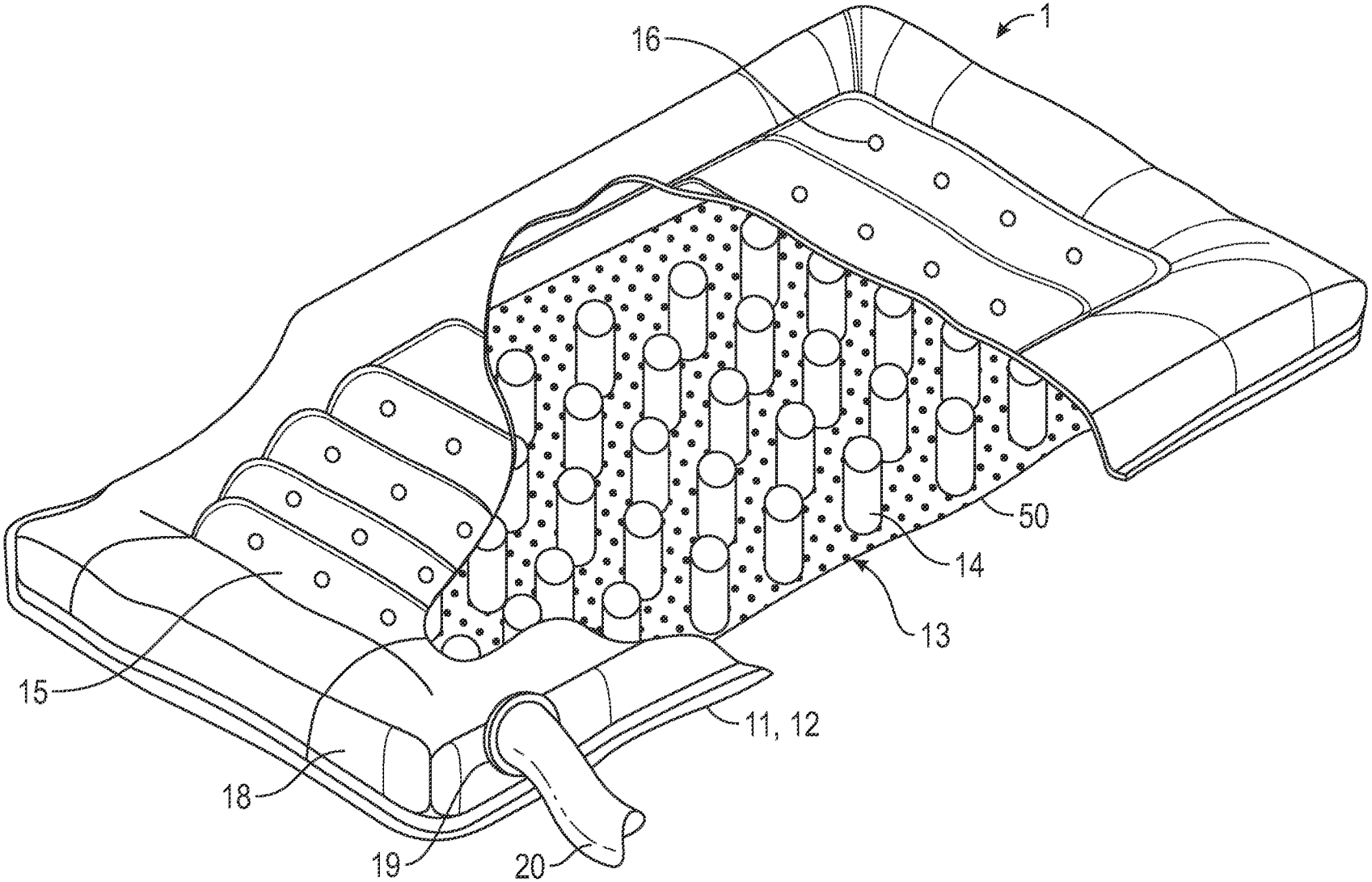
FIG. 3 is a partial perspective cutaway view of one of the panels of the wearable thermal conditioning system of FIG. 2.

FIG. 3 depicts an embodiment of the panel 1 that has an inlet 20 that allows cold air or heat to be blown inside of the panel 1. Small cylindrical columns or pillars 14 are used to structurally support opposing sides of the panel 1 to keep airflow moving therethrough while the panels 1 are compressed, for example so a human subject can have full mobility while wearing the vest. The panels 1 may have a ¼" (inch) thick side panel 18 that abuts a ¼" diameter inlet 20. The panels 1 may be rectangular and/or horizontal strips that can wrap around a user's body. One side of the panel 1 can be non-porous or porous as shown by the small holes 13. The holes 13 may be openings allowing cold or hot air to seep out of the panel 1. The opposite side, the bottom inside layer 15, may have blow holes 16. The blow holes may allow for thermally conditioned air to seep out. Alternatively, the bottom inside layer 15 can be sealed to make the cold air seep through only the small holes 13. The concept of the panel 1 may be designed like a blowup air mattress with stout columns. The panels 1 may be used with a system having the peltier cooling system 5A and a diaphragm pump 4 or pressure pump as described herein, or any of the other systems, such as those shown in FIGS. 2-10.

As further shown in FIG. 1, the peltier devices 5A may be thermoelectric devices, e.g., thermoelectric coolers (TEC) or heaters, and operate by the Peltier effect, also known as the thermoelectric effect. The peltier device 5A may create a heat flux at the junction of two different types of materials for example by Kryotherm. To protect TEC's from moisture and condensation, Kryotherm TECs may be sealed along the perimeter with silicone or epoxy sealant—such as shown by S, E indices in the name of thermoelectric coolers. TEC's are attached to the surfaces of a heatsink and plate. It may be required to grind the surfaces of the heatsink and plate providing for flatness of at least 0.035 mm (25 micron) on the linear dimension of TEC being installed. This may prevent bending and distortion of the heatsink and plate with a positive and negative charge with the cool side inward and heat going outward and connected to the battery 3. The peltier cooler, heater, or thermoelectric heat pump may be a solid-state active heat pump which transfers heat from one side of the device to the other, with consumption of electrical energy, depending on the direction of the current. In some embodiments, the peltier device 5A may have two sides, and when a direct current (DC) electric current flows through the device, it brings heat from one side to the other, so that one side gets cooler while the other gets hotter. The "hot" side is attached to a heat sink, e.g. discharged to the ambient air which is at a lower temperature than the heated side, so that it remains at ambient temperature, while the cool side cools, e.g. goes below room temperature. In special applications, multiple coolers can be cascaded together for lower temperature.

FIG. 2 is a front view of another embodiment of a wearable thermal conditioning system using the panels 1 for most or the entire wearable. The system of FIG. 2 may use a nitrogen generator, freeze box and the regenerative tubing 2. The system of FIG. 2 may use any of the other systems, such as those shown in FIGS. 3-10. One such system includes the nitrogen generator 21 or mini microcooler with a pulsating cold finger 21A, batteries 3, diaphragm pumps 4, freeze box 6 and regenerative tubing 2 to supply cold air to the panels 1 throughout the vest, as further described herein.

The system delivers nitrogen gas, or uses ice or ice crystallization, to cool through the vest liner itself or by regenerative tubing. The vest liner keeps a user cold in extreme heat and helps a human or animal experience the benefits of cryogenics, such as strengthened immune system, decreased pain, swelling and inflammation, increased energy, and the like. The same procedure may be used instead to provide heating.

In various embodiments the system may be incorporated and configured to be used as a built-in or external unit as clothing, blankets, tents, and homes by using high pressure lines with dosing nozzle tips that work like a fire suppression system. The system may be worn indoors and outdoors.

The systems of FIGS. 1 and 2 may use the panel 1 described in FIG. 3. The systems of FIGS. 1 and 2 may include pillars 14 such as mini micro I-beam coils or cooling columns with molecular sieve pellets, with pressure sieving adsorption that are strategically placed between two or more layers of clothing textile, as shown in FIG. 3, that are sealed with unobstructed passageways for even cooling throughout the entire vest. Seepage or small holes 13 may be used for disbursement of hydrogenated gas or cold air that use regenerative tubing 2 that connects to the mini micro diaphragm pump 4 or mini micro compressor that uses batteries that supply power to the peltier device system 5A. The Peltier device 5A may use positive and negative wires attached to the battery 3 to create heat on one side and cooling on the other side of the metal using Kryotherm sealant between two plates of metal.

Figure 6:
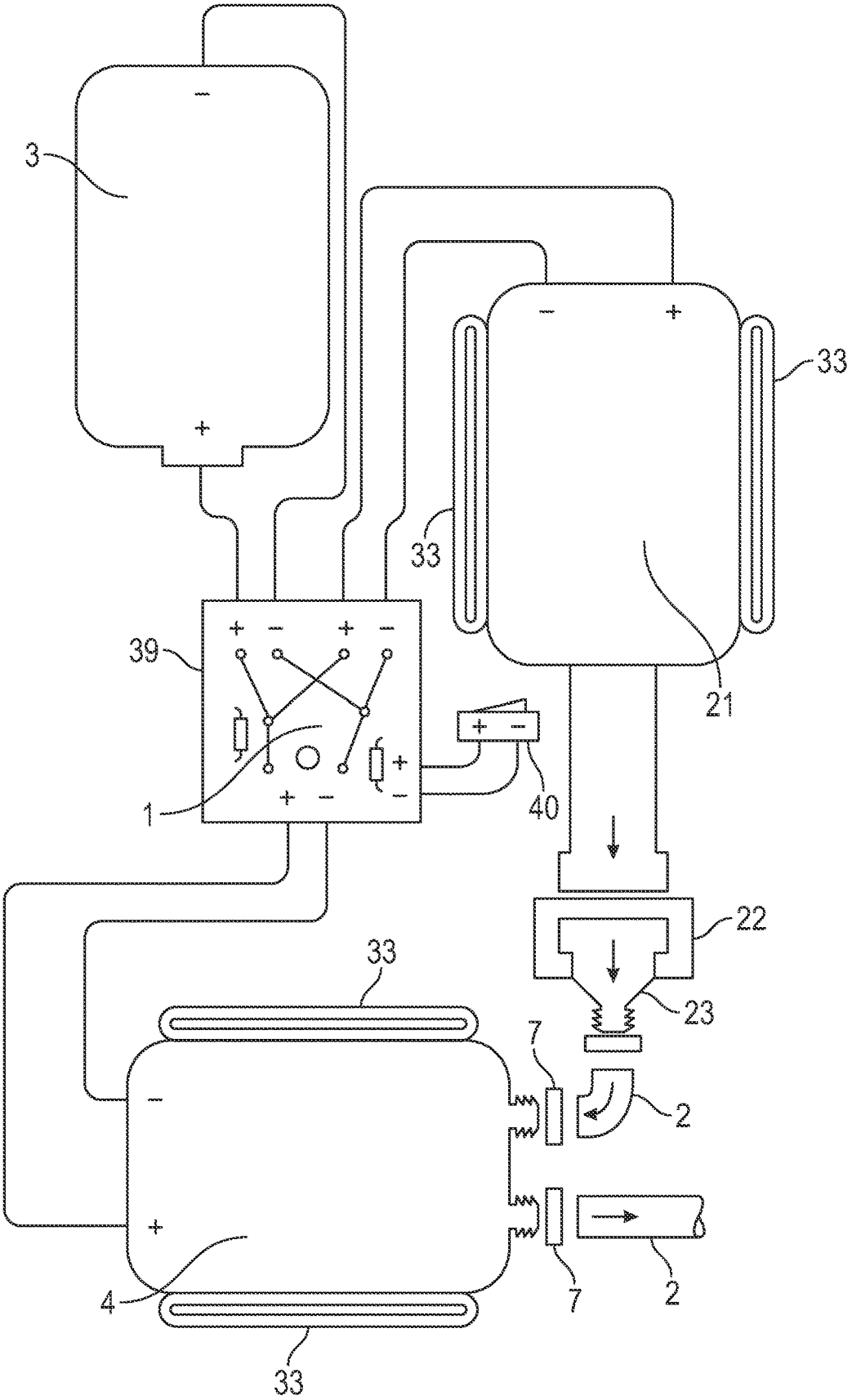
FIG. 6 is a front view of an embodiment of a thermal conditioning system that may be used with the various wearable systems described herein and that uses a Stirling mini micro nitrogen generator.

A precharged cannister system 5B, a nitrogen generating system 5C or a pulsating tube 5D could also be included in the thermal conditioning system of FIG. 6, which further depicts a solid state refrigerator 33 wrapped around a coil or cooling element to produce cold air while other embodiments may use mini micro HVAC refrigeration, or the like, or mini micro heating or the like. In various embodiments, these systems may connect inline or by using dual diaphragm pumps 4 or combination using a compressor that may or may not incorporate and configure a freeze box 6, and then use the regenerative tubing 2 to disperse cold air to its various embodiments either using the panel 1 or tubing 2 for direct skin contact with air. Zippers, buttons or snaps may be used for pockets and zipping up the vest in the proper manner.

FIG. 3 is a partial perspective cutaway view of one of the panels 1 of the wearable thermal conditioning systems of FIGS. 1 and 2. The inside liner of the vest as a panel 1 may be visible and can be used for the entire vest. Various features and materials may be used such as clothing textiles, I-beam coils or cooling columns, air holes, a seal and regenerative tubing.

The panel 1 may incorporate front clothing textiles and appear as a vest panel or could be formed as a sheet of substantially stainable fabric, i.e., a woven or entangled mass of fibers, aramid fibers, polymer, or a film that can make an airtight seal or can adhere an air tight liner for the cooling panels or entire vest liner. An emulsion may be added to these textiles to reduce susceptibility to permanent staining by, e.g., semi-solids and liquids, such as blood, urine, feces, hospital strength disinfecting compounds, alcohol, or the like on outer surface fibers or coatings. In some embodiments, where human use lasting less than twenty four hours is desired, fibers or forming fabrics suitable for the entire exterior or panels may be made of materials such as acetate, acrylic, anidex, aramid, azlon, cotton, elastoester, fluorocarbon, fur, glass, hemp, lyocell, melamine, metallic, modacrylic, modal, mosacrylic, novo loid, nylon, mytril, olefin, PAN, PBI, PEEK, Pelco, PEN 10 15 20 25 30 35 40 45 50 60 65 4PLA, PTT, polyester, polyester-polyarylate, rayon, saran, spandex, sulfur, triacetate, vinyl, vinyon, wool, other suitable materials, or combinations thereof. A common characteristic of the foregoing and like materials is their propensity to stain or discolor as a result of contact with blood, urine, feces, hospital strength disinfecting compounds, alcohol, or the like. copolyester, polyether, ethylene vinyl acetate, fluorocarbon, polyamide, olefins, polybutylene, polycarbonate, polyester, polystyrene, polyurethane, polyvinyl, alcohol, polyvinyl, chloride, polyvinyl fluoride, polyvinylidene chloride.

The textiles may all be airtight when sewn or melted together at the seams although the bottom inside layer can also be used for seepage to where the entire inside layer remains cool and there are no air holes and fabric seeps cold air onto skin instead of mini micro air holes. A top outside textile can also use phase change fabric that controls temperature by taking the heat and exchanging it to cool on the bottom layer of textile, such as NASA-grade material. Other materials for fabric like carbon fiber, carbon kevlar hybrid, fiberglass, flex fiber, hemp, kevlar or the like would be Military grade. Other exterior layers could be solar or the like.

In various embodiments, exterior of vest top layers 11, 12 may be glued with adhesive, melted or sewn onto the side panels 18. There may be a quarter inch to (¼") to one inch (1") thickness side panel 18 that is glued with adhesive, melted or sewn onto the I-beam coil-cooling pillar textile platform sheets 50 and/or I-beam coil cooling pillars 14. The pillars 14 may be structural members separating the two opposing sides of the panel 1 to allow for airflow between the opposing sides. The I-beam coil cooling pillars 14 and side panels 18 may be glued with adhesive, melted or sewn onto the bottom inside layer 15. The bottom inside layer 15 may use seepage or small blow holes 16 spread out throughout the panels 1, or an entire liner for direct nitrogen gas or cold air skin contact. The side panels 18, or other panel access, to pressurize the panels or liners may use seals 19 and regenerative tubing 20 channels or the like to pressurize air into the panels 1 or liners for Nitrogen gas or cold air to keep cool. This may be done by utilizing a diagram pump 4 connected to the batteries 3. The air is pressurized and seeps out of small holes 13 or can be blown out of the liner 15 via blow holes 16. Whichever method is used, the other side is sealed so that the cold air is blown or seeped onto the users skin.

Figure 4:
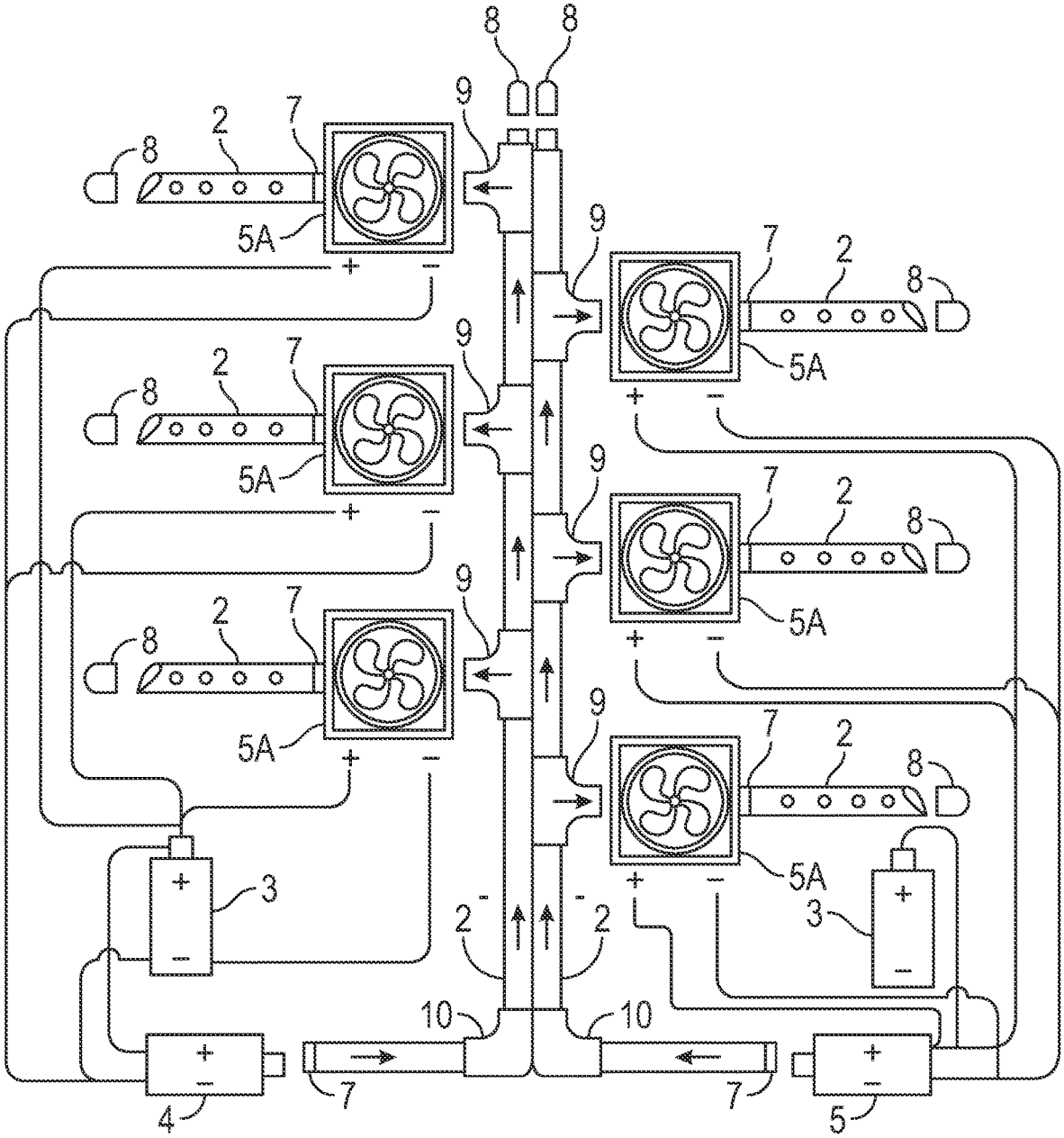
FIG. 4 is a front view of an embodiment of a thermal conditioning system that may be used with the various wearable systems described herein and that uses multiple Peltier devices and fans.

FIG. 4 is a front view of an embodiment of a thermal conditioning system that may be used with the various wearable systems described herein, such as those of FIGS. 1-3, and that uses multiple peltier devices 5A and fans. The regenerative tubing 2 may extend anywhere that air supply is needed for a human or animal to allow nitrogen gas or cold air to hit the skin. The tubing 2 may end at one or more end fittings, as shown. In some embodiments, the tubing 2 may extend around the body and reconnect to itself to form a continuous circuit for regenerative use of the air therein. The regenerative tubing 2 may use end fittings 8 shown as end caps, branch fittings 9 shown as T-fittings, and elbows 10, that can be made out of acrylic, cast acrylic, CPVC, fiberglass, nylon tubing, polycarbonates, polyethylene, polystyrene, silicone vinyl, polypropylene, HDPE high density polypropylene, PTFE tubing, High Density cross linked polyethylene or XLPE, carbon fiber, carbon Kevlar hybrid, fiberglass, flax fiber, hemp, other suitable materials, or combinations thereof.

A clamp 7 may be used for barbed fittings and a base that can be molded onto a vest or composite of exterior units. The clamps 7 secure to the regenerative tubing 2 to provide cooling where needed, otherwise the regenerative tubing 2 can slide into cloth channels or be used as piping and melted, adhesively glued, or sewn onto a vest. The clamps 7 also attach to the mini micro diaphragm pump 4 and/or mini micro air compressor, e.g. that has 8,000-11,000 hours of continual use or the like.

The regenerative tubing 2 uses compressed air to push air through the peltier devices 5A that use positive and negative energy with a heat sink, two plates of metal and a fan that creates ice. A solid state refrigerator may or may not be used to cool the peltier device 5A. The peltier devices 5A have an airtight concealed encasement to allow compressed air to pass through and blow air through micro holes in the regenerative cooling tubing 2 and/or panels 1.

One or more batteries 3 may provide power for the system. In some embodiments, the peltier device 5A and diaphragm pump 4 and/or air compressor mount to the vest or an exterior unit and may be used to power the system. The system may be powered with betavoltaics, opto electric, nuclear batteries, aromic, sodium ion, lithium ion, lithium sulfur, nano silicon, solar, energy capturing from wifi or connect to any external power source including power supplies, car adapters any plug or socket male or female to any fixed equipment or building structure, power cords connecting universal sockets or plugs. Battery terminal or direct battery connects to external units may be used, e.g. for airplanes, ATV's, boats, cars, military vehicles, motorcycles or the like. Wire thicknesses from 0.03 millimeters (mm) to 200 mm or the like may be used insulated with chlorinated polyurethane, ETFE, ethylene, FEP, fiberglass, halar, neoprene rubber, nylon, PFA, plenum, polyvinyl chloride, polyvinylidene fluoride, PTFE, Semi-Rigid PVC, Rubber, Silicone, thermoplastic Styrene Butadiene rubber, or Thermoplastic elastomers for all component wires, covers and mounting bushings.

The system includes the mini micro diaphragm pumps 4, 5 or mini micro air compressor for air and/or gas. The pumps 4, 5 or compressors may be high pressure, high pneumatic pressure, uncontaminated media transfer, low noise, small size, low pulsation, low power consumption, high gas tightness, can be installed in any orientation, internally ported, maintenance free, provide pressure up to and over 43.5 pounds per square inch gauge (PSIG), direct current (DC) and brushless DC (BLDC) motors, can use downloadable software or the like. The diaphragm pump 4 or compressor is powered by batteries 3. The pumps 4, 5 may have a barbed or other type fitting that connects to the clamp 7. Pumped air or gas travels through the regenerative tubing 2 that passes through the peltier device 5A, sending cool air through the regenerative tubing 2 with micro holes for cooling with air pressure directly onto the user's skin. In some embodiments, the pump 5 may be replaced with a precharged cannister system 5B, a nitrogen generating system 5C, and/or a pulsating tube 5D.

Figure 5:
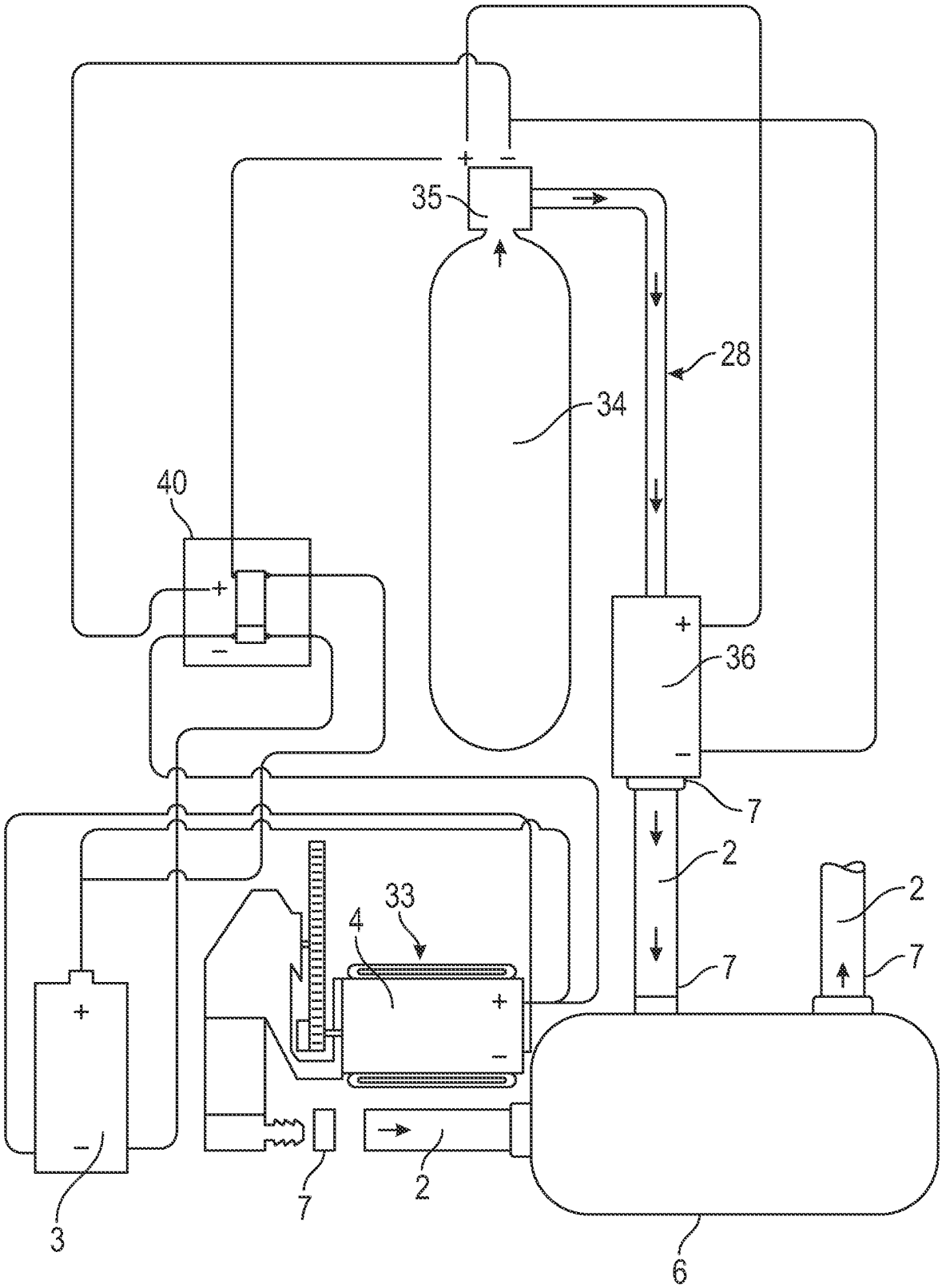
FIG. 5 is a front view of an embodiment of a thermal conditioning system that may be used with the various wearable systems described herein and that uses a gas canister and computer-controlled valve and vacuum.

FIG. 5 is a front view of an embodiment of a thermal conditioning system that may be used with the various wearable systems described herein and that uses a gas canister 34, freeze box 6, and computer-controlled valve 40 and vacuum 36. The system of FIG. 5 may be used with, for example added to, the various wearable thermal conditioning systems herein, e.g. those shown in FIGS. 1 and 2.

The vacuum 36 can be added inline that uses positive and negative energy connecting to a regulator 35 and dosing nozzle and or using a dual port in/out diaphragm pump 4 or compressor to pressurize the system using the pre-filled nitrogen gas canister 34. The canister 34 passes through the regulator 35 and diaphragm vacuum pump 4 into regenerative tubing 2 and may use the freeze box 6 or pressurize the system and provide cooling through regenerative tubing 2 with micro holes for direct to skin cooling with nitrogen gas or using the panels 1 (e.g. shown in FIG. 3) using microscopic holes in clothing textile or fabric seepage.

FIG. 6 is a front view of an embodiment of a thermal conditioning system that may be used with the various wearable systems described herein and that uses a sterling mini micro nitrogen generator. The system of FIG. 6 may be used with or added to the various wearable thermal conditioning systems described herein, e.g. those shown in FIGS. 1 and 2.

A miniature micro Stirling cryo-cooler 21 in various embodiments uses feedthrough pins and interacts with the stater assembly, which interacts with permanent magnets attached to the piston assembly and causes the piston to oscillate. The piston's movement creates a pressure wave that causes the displacer assembly to move. The displacer rod connects the assembly to a planer spring that's designed to resonate at the cryo-cooler operating frequency. The cryo-cooler moving parts are encased in a hermetically sealed enclosure filled with helium gas which eliminates the need to refill the cryo-cooler. Gas bearing technology harnesses the pressure wave generated by the piston funneled through a one way valve and out several locations on the piston outer diameter. The same gas bearing technology is also used on the displacer valve. This keeps the piston and displacer centered in the cylinder achieving contact free operation and enabling a long life vibration that can be reduced by the active or passive balancer.

The key to achieving the cooling effect is the relationship of the movement between the piston and displacer when the displacer movement results in the bulk of the working gas being located between the displacer and cold tip. The piston expands the gas based on the ideal gas law and the relationship between pressure, volume, and temperature. This causes the temperature of the gas to decrease, as the temperature decreases it absorbs or lifts heat through the cold tip causing the cold tip temperature to also decrease. When the displacer movement results in the movement of the working gas being located between the displacer and piston, the piston compresses the gas again based on the ideal gas law. This causes the temperature of the gas to increase, and as it increases it transfers and rejects heat from the gas through a heat exchanger to the environment.

Inside the displacer is a structure called the regenerator. The regenerator alternately stores and releases the heat of the helium gas to drastically increase the cycle officially. Since this cycle occurs sixty six times per second, the net effect is the temperature of the cold tip drops to negative two hundred and thirty degrees Celsius (−230° C.) or forty degrees Kelvin (40K).

The cold tip is housed with a titanium clamp 22 attached to a titanium funnel 23 that has a barbed tip. The barbed tip is attached to the regenerative tubing 2 with the clamp 7. The regenerative tubing 2 is attached to the vacuum diaphragm pump 4 inlet with a barbed tip and dispersed through the outlet with a barbed tip. The clamp 7 is attached to the regenerative tubing 2 in the various embodiments of the thermal conditioning system described herein to extend and provide cooling anywhere that air supply is needed for a human or animal to allow nitrogen gas or cold air to hit the skin, as described above.

The wearable thermal conditioning system may be a vest liner that can be one piece that encompasses the entire vest's inner layer or use panels 1 such as shown in FIG. 3 that an entire interior liner can incorporate. An on/off switch 40 may be provided for easy operation and the temperature can be achievable by use of a controller/regulator mini micro motherboard 34, e.g. with cell phone technology and software to control and provide cooling to the user's liking.

Figure 7:
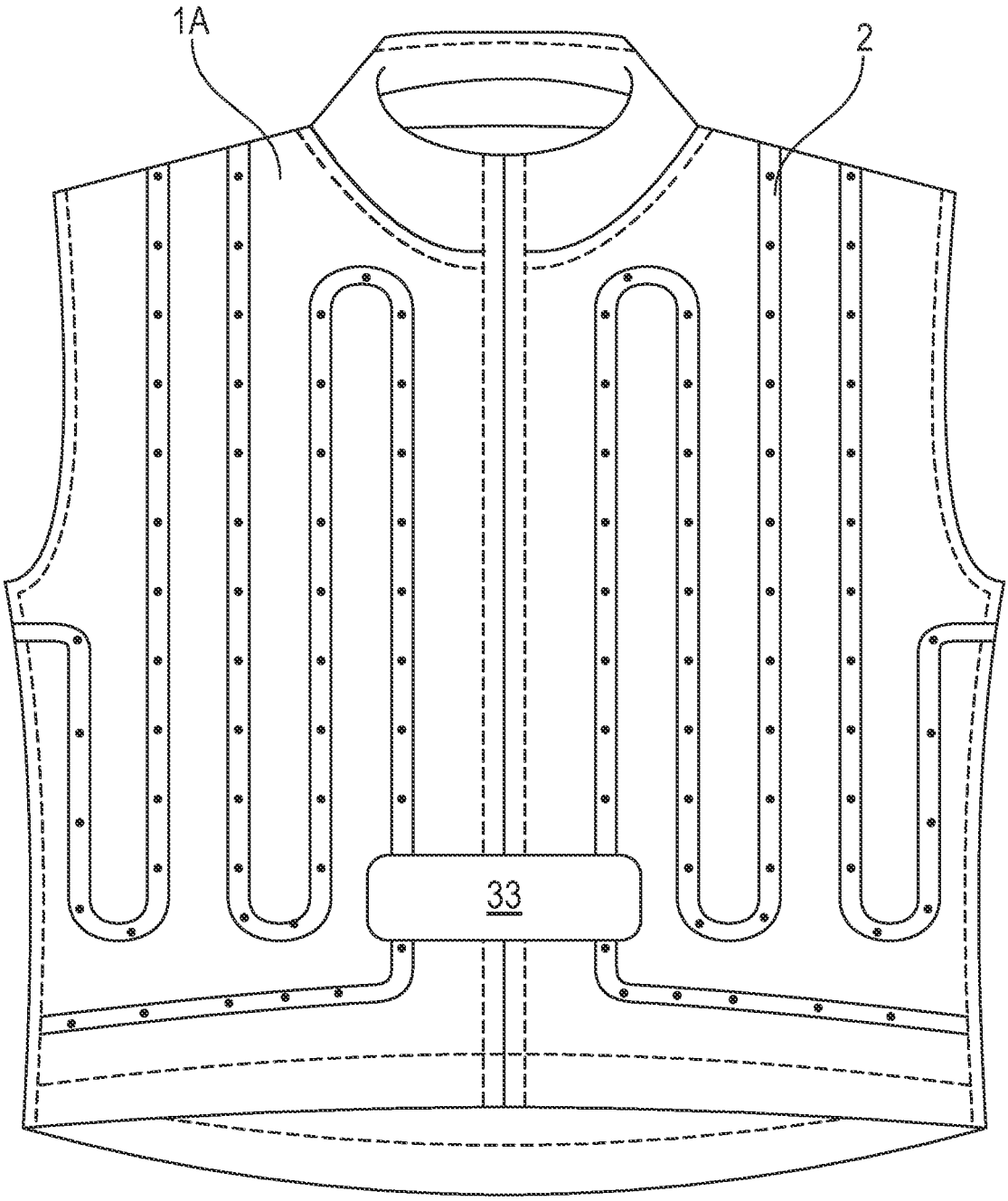
FIG. 7 is a front view of an embodiment of a wearable thermal conditioning system using porous regenerative tubing and a solid-state refrigerator plate.
Figure 8:
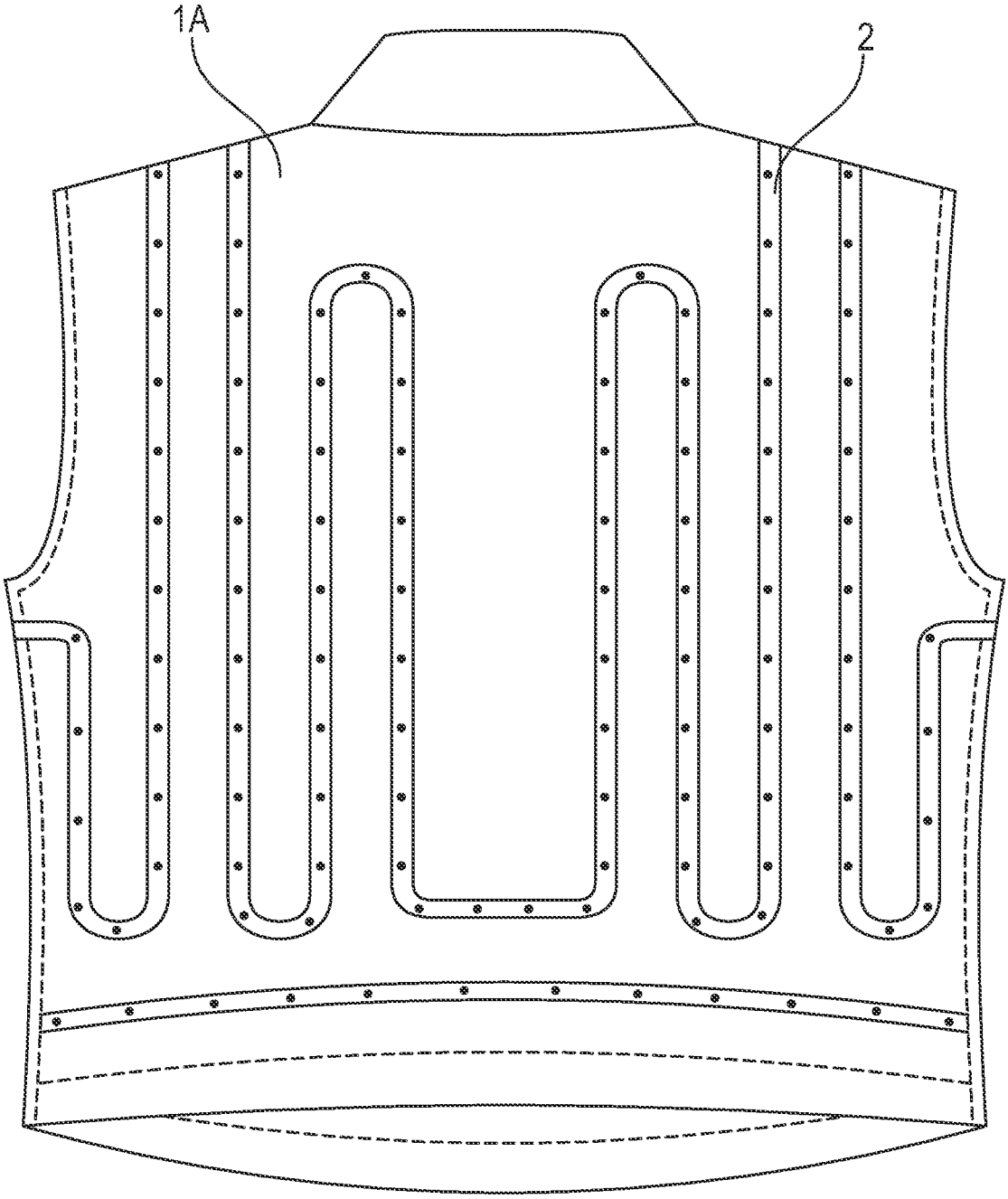
FIG. 8 is a rear view of an embodiment of a wearable thermal conditioning system using porous regenerative tubing.
Figure 9:
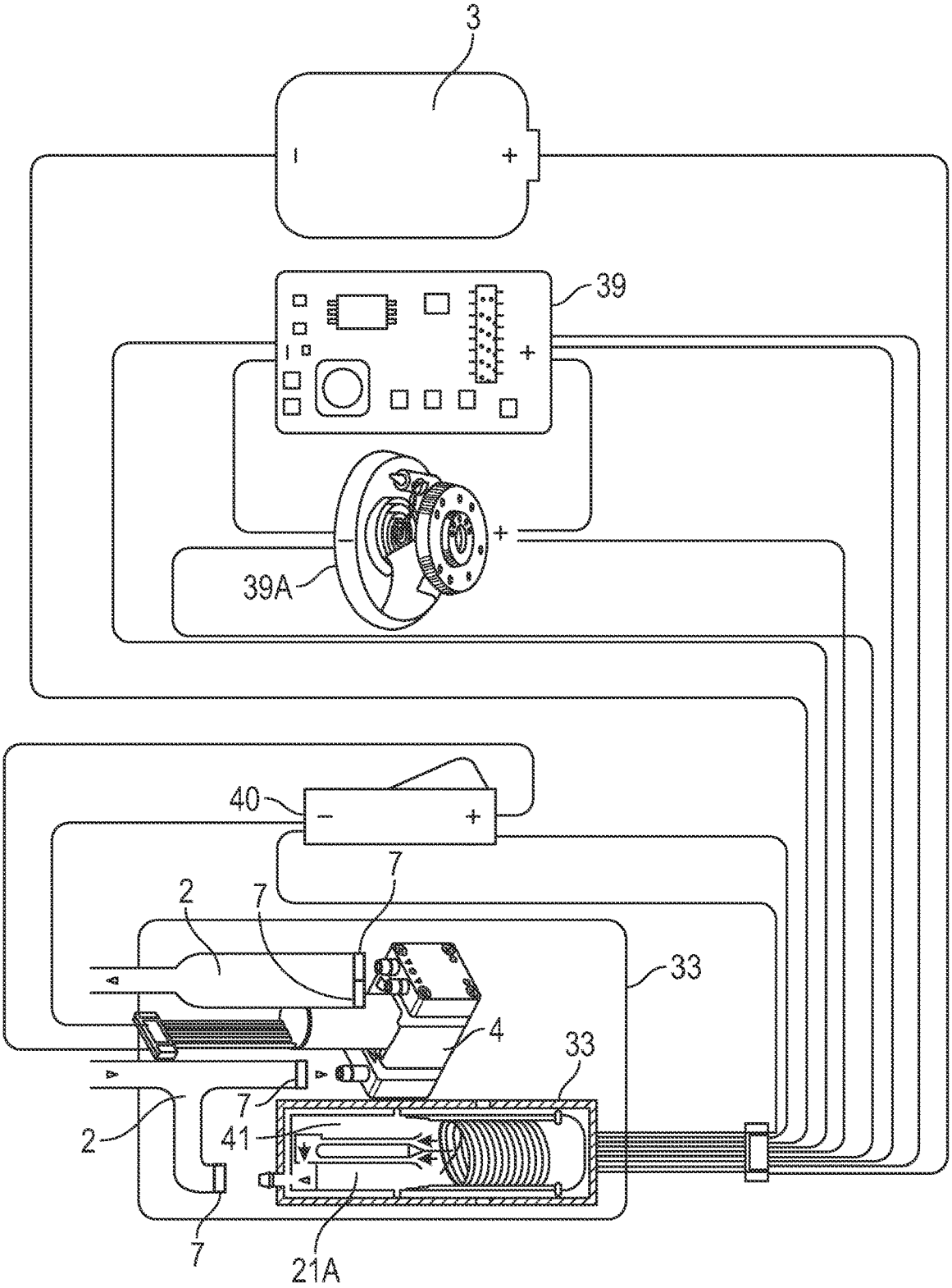
FIG. 9 is a front view of a thermal conditioning system that may be used with the various wearable systems described herein and that uses a mini cryocooler with a pulsating cold finger and thermostat.

FIG. 7 is a front view of an embodiment of a wearable thermal conditioning system using porous regenerative tubing and a solid-state refrigerator plate 33. FIG. 8 is a rear view of an embodiment of a wearable thermal conditioning system using porous regenerative tubing. FIG. 9 is a front view of a thermal conditioning system that may be used with the various wearable systems described herein and that uses a mini cryocooler with a pulsating cold finger 21A and thermostat 39A. The system of FIG. 9 may be added to the wearable thermal conditioning systems of other embodiments described herein, e.g., those shown in FIGS. 7 and 8.

As shown in FIG. 9, miniature micro cryocooler with a pulsating cold finger 21A may be used. The cold finger 21A in various embodiments may be applicable where lifetime, vibrations, and noise are considerations, which can improve the functionality of the wearable thermal conditioning system. In some embodiments, the mini cryocooler combines a flexure bearing moving magnet compressor and piston instead of the pulse tube cold finger. With a pulse tube cold finger the result in a design that is intrinsically balanced and therefore low on vibration, while eliminating the need for a moving mass in the cold finger, thus improving reliability by removing a potential wear mechanism.

The pulse tube cryocooler is specially developed for applications where the object to be cooled is extremely sensitive to vibrations. The absence of moving parts in the pulse tube cold head diminishes the influence of most of the disturbances at the cooler-detector interface. The pulse tube cryocooler is able to produce and sustain a detector operating temperature of about 80 K. The combination of a cold head with no moving parts and the reliable moving magnet flexure bearing compressor guarantees the high reliability of this cooler type. In some embodiments, the pulse tube cryocooler has a moving magnet flexure bearing design and a closed loop control of detector temperature.

Some of the characteristics of an embodiment of the pulse tube cryocooler include dual opposed pistons driven by linear motors, compact magnetic circuit optimized for motor efficiency, pulse tube cold head with no moving parts, and/or suitability for direct mount highly sensitive detectors.

The mini cryocooler with a pulsating cold finger 21A also known as a pulse tube, can be housed within a solid-state handheld refrigerator 33 or metal shroud. Additionally, a second solid state refrigerator 33 may be used to house additional components of the system as shown in FIG. 9. In some embodiments, the whole system may be covered by one, or multiple solid state refrigerators 33. Further, the inlet and outlet of the pulsating cold finger 21A may have an air inlet ranging from the size of a needle to the size of a fire hydrant nozzle and may or may not need a vented cover (not shown). The solid state refrigerator 33 may also take the form of a metal shroud which may have a broad range of heat transfer properties and may be made from a variety of materials not limited to metal. In some embodiments the material may be a single material, a composite material, or rather several layers of similar or differing material. This material may include steel or any other kind of metal, polymer or carbon based materials, or other materials commonly used to maximize or minimize heat transfer such as insulation materials. In one embodiment, the metal shroud may have a steel structure with an inside insulator material and an outside material such as polypropelene. In some embodiments, the insulation material will allow a user to be able to comfortably touch the outside of the metal shroud.

Figure 10:
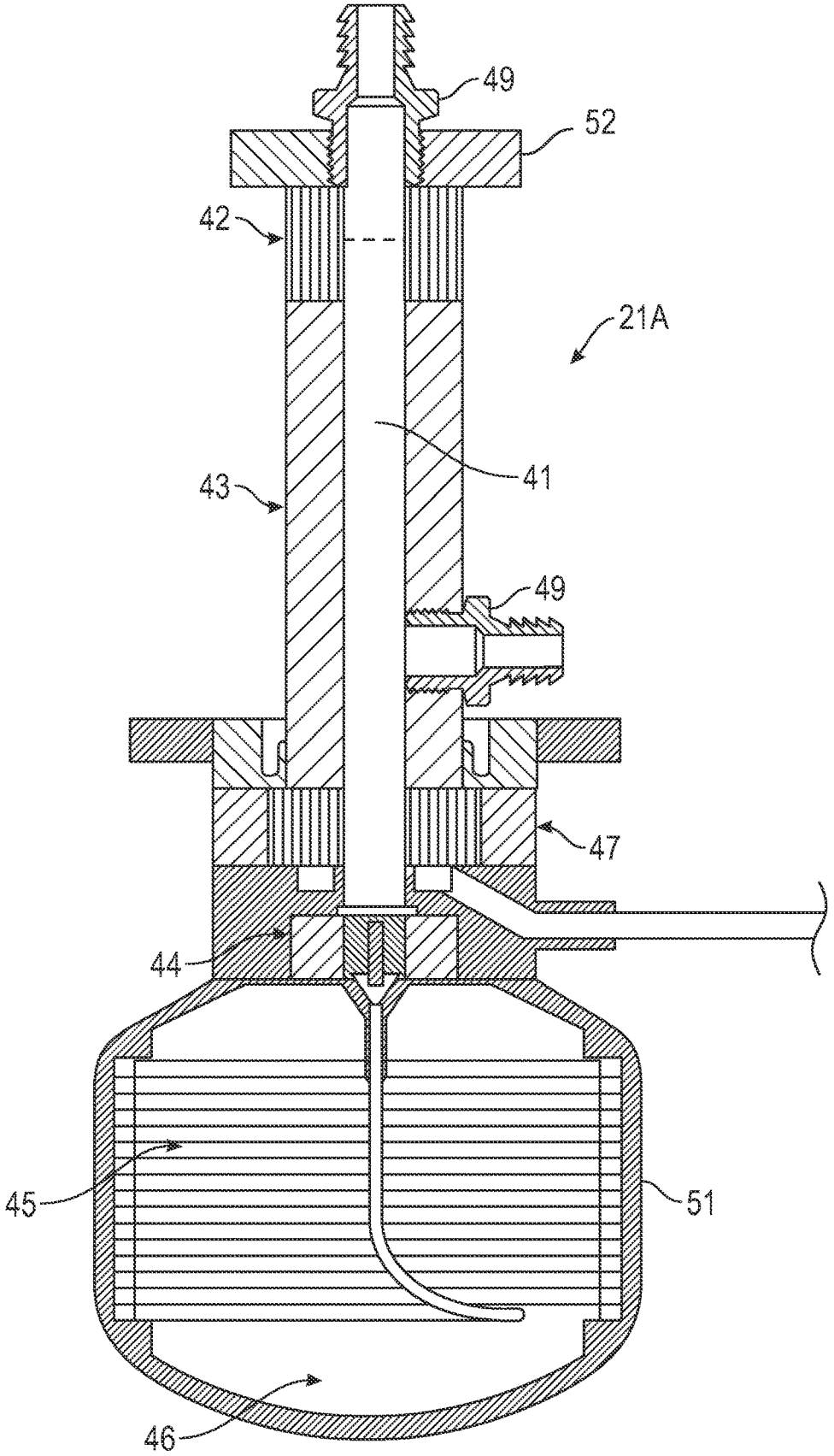
FIG. 10 is a sideview of an example pulsating cold finger that may be used with the various thermal conditioning systems herein.

FIG. 10 is a cross-sectional view of a pulse tube 21A that may be used with the various systems herein. As seen in FIGS. 9-10, the cold tip 52 can be housed with a titanium barbed fitting 49, brass tip, or similar fitting that can be used with a cold tip 52. The metal clamp 7 is attached to an oxide free, high conductivity copper and is attached to the cold tip 52 with the clamp 7. The regenerative tubing 2 may be attached to the vacuum diaphragm pump 4 inlet and the barbed fitting 49 which may screw into the regenerator side 43. The clamp 7 may be attached to the regenerative tubing 2. The pulse tube 21A includes inertance coils 45, one or more cold heat exchangers 42, one or more hot heat exchanger(s) 44 and one or more heat exchanger(s) 47 along positive and negative charges.

The pulse tube 21A produces extremely cold air by vibration and has a buffer space 46 inside of the mini micro cryocooler 51. The cold tip 52 lets the cold air from the cold tube 41 release into the inlet of the vacuum of the diaphragm pump 4 and push out of the diaphragm pump 4 with two or more pressure pumps. This allows a higher pressure to be pushed out of the diaphragm pump 4 than the pressure into the diaphragm pump 4, thus allowing a loop of cold air through the pulse tube 21A while at the same time blowing cold air out of the blowholes 16 in the tubing 2 throughout the vest. In the various embodiments of the thermal conditioning system described, the system may use a loop system with a vacuum pump 4. The system may also use a miniature air compressor 4 with compressed air moving through tubing 2 to extend and provide cooling anywhere that air supply is needed for a human or animal to allow cold air down to −80 K to hit the skin, as described above. The thermal conditioning system is also connected to any conformable battery 3.

The wearable thermal conditioning system may be a vest liner that can be one piece that encompasses the entire vest's inner layer, such as shown in FIGS. 7 and 8 that an entire interior liner can incorporate. An on/off switch 40 may be provided for easy operation. The desired temperature can be achievable by use of a controller/regulator/temperature sensor and mini micro motherboard 39. The motherboard 39 can be used manually with a thermostat 39A or cell phone technology and software to control and provide cooling to the user's liking.

Various modifications to the implementations described in this disclosure will be readily apparent to those skilled in the art, and the generic principles defined herein can be applied to other implementations without departing from the spirit or scope of this disclosure. Thus, the disclosure is not intended to be limited to the implementations shown herein, but is to be accorded the widest scope consistent with the claims, the principles and the novel features disclosed herein. The word "example" is used exclusively herein to mean "serving as an example, instance, or illustration." Any implementation described herein as "example" is not necessarily to be construed as preferred or advantageous over other implementations, unless otherwise stated.

Certain features that are described in this specification in the context of separate implementations also can be implemented in combination in a single implementation. Conversely, various features that are described in the context of a single implementation also can be implemented in multiple implementations separately or in any suitable sub-combination. Moreover, although features can be described above as acting in certain combinations and even initially claimed as such, one or more features from a claimed combination can in some cases be excised from the combination, and the claimed combination can be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. Additionally, other implementations are within the scope of the following claims. In some cases, the actions recited in the claims can be performed in a different order and still achieve desirable results.

It will be understood by those within the art that, in general, terms used herein are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

What is claimed is:

1. A wearable thermal conditioning system comprising:

a wearable garment;

at least one cryocooler attached to the wearable garment;

one or more tubes having openings along a length thereof, each tube fluidly connected the at least one cryocooler and extending across a respective region of the wearable garment where cooling is to be supplied;

a pump attached to the wearable garment and configured to pump air across the at least one cryocooler and through the one or more tubes; and a power source attached to the wearable garment and configured to power the at least one cryocooler and the pump.

2. The system of claim 1, further comprising one or more panels fluidly connected to the one or more tubes, the panels comprising a series of openings, wherein the openings are configured to enable pumped air to be expelled through the openings to provide cooling.

3. The system of claim 2, wherein the one or more panels cover a majority of the surface area of the wearable garment.

4. The system of claim 2, wherein at least one of the one or more tubes fluidly connects the one or more panels to the pump.

5. The system of claim 1, further comprising a thermostat.

6. The system of claim 1, wherein the wearable garment is a vest.

7. The system of claim 1, further comprising one or more peltier devices, wherein the power source attached to the wearable garment is further configured to power the one or more peltier devices, and wherein a positive wire and a negative wire are attached to the power source to create heat on one side of metal in the one or more peltier devices and cooling on the other side of the metal in the one or more peltier devices.

8. The system of claim 7, additionally comprising a coil in contact with the one or more peltier devices.

9. The system of claim 1, wherein the at least one cryocooler comprises a cold finger.

10. The system of claim 9, wherein the at least one cryocooler comprises a nitrogen generator.

11. The system of claim 1, wherein the at least one cryocooler comprises a Stirling cryo-cooler.

12. The system of claim 11, wherein the Stirling cryo-cooler comprises a cold tip.

13. The system of claim 1, additionally comprising a freeze box.

14. The system of claim 1, wherein the pump comprises a vacuum diaphragm pump.

15. The system of claim 14, wherein a cold tip of the at least one cryocooler is connected to an inlet of the vacuum diaphragm pump.

16. The system of claim 1, further comprising:

a freeze box attached to the wearable garment;

a gas canister in fluid connection with the freeze box;

a series of at least one of porous tubes or porous panels fluidly connected with the freeze box, wherein each of at least one of the porous tubes or the porous panels extends across a respective region of the wearable garment where cooling is to be supplied;

a vacuum diaphragm pump attached to the wearable garment and configured to cause air thermally conditioned by the freeze box to move through at least one of the porous tubes or the porous panels; and the power source further configured to power the freeze box and the pump.

17. The system of claim 1, further comprising:

a miniature micro cryocooler having a pulsating cold finger, the cryocooler attached to the wearable garment; and each tube extending from the miniature micro cryocooler and across a respective region of the wearable garment where cooling is to be supplied.

* * * * *